US006484759B1

(12) United States Patent
Chembakassery et al.

(10) Patent No.: US 6,484,759 B1
(45) Date of Patent: Nov. 26, 2002

(54) KNOT-TYING MECHANISM

(75) Inventors: George M. Chembakassery, Kenosha, WI (US); George T. Vattakattu, Deerfield, IL (US)

(73) Assignee: Frank L. Wells Company, Kenosha, WI (US)

( * ) Notice: Subject to any disclaimer, the term of this patent is extended or adjusted under 35 U.S.C. 154(b) by 0 days.

(21) Appl. No.: 09/885,544

(22) Filed: Jun. 20, 2001

(51) Int. Cl.[7] ..... B21F 35/02
(52) U.S. Cl. ..... 140/101
(58) Field of Search ..... 140/101, 115

(56) References Cited

U.S. PATENT DOCUMENTS 1,651,518 A * 12/1927 Fencl ..... 140/101
2,759,500 A * 8/1956 Nelson ..... 140/101
5,477,893 A * 12/1995 Wentzek et al. ..... 140/101

* cited by examiner

*Primary Examiner*—Lowell A. Larson
(74) *Attorney, Agent, or Firm*—Boyle, Fredrickson, Newholm, Stein & Gratz, S.C.

(57) ABSTRACT

A coil spring knotting machine including a frame and a camshaft mounted on the frame about an axis fixed relative to the frame. The camshaft supports a support member having thereon a knot-tying member mounted for rotation about an axis movable with respect to the frame. The camshaft also supports a free-wheeling rotating member. The machine further includes a first drive member rotatably driving the camshaft without causing rotation of the rotating member, and a second drive member rotatably driving the rotating member without causing rotation of the camshaft. A linkage connects the rotating member to the knot-tying member to rotate the knot-tying member. Preferably, the linkage includes a flexible member and a movable tensioning member for adjusting the tension in the flexible member.

20 Claims, 6 Drawing Sheets

KNOT-TYING MECHANISM

FIELD OF THE INVENTION

The invention relates generally to machines or mechanisms for knotting the free ends of a coil spring to the adjacent end convolution of the coil spring.

BACKGROUND OF THE INVENTION

Early knot-tying machines were powered and driven by a single camshaft assembly which was cyclically operated by a one-revolution mechanical clutch that was spring biased and pneumatically operated. The mechanical clutch was excessively noisy and caused excessive wear on the gears with every engagement.

Furthermore, the knot-tying or twisting member (to be described hereinafter) was driven from the camshaft by a partial gear, i.e., a gear which had only a limited arcuate range of teeth. This partial gear was removably fixed on the camshaft for periodic driving actuation of the knot-tying or twisting member. When it was desired to change the size of the knot, i.e., to vary the number of turns therein, it was necessary to at least partially disassemble the camshaft assembly to permit removal of one partial gear and then to reassemble the camshaft assembly with another partial gear. Such disassembly and reassembly resulted in appreciable machine down time and was also labor intensive. Thus, it was expensive to disassemble and reassemble the camshaft assembly to vary the number of turns in the knot.

U.S. Pat. No. 5,477,893 discloses a knot-tying machine that operates without the mechanical clutch and partial gear configuration. Rather, the knot-tying member is independently driven by a dedicated servo-motor that can be electrically controlled to vary the number of turns in the knot. The machine incorporates a coupling, which takes the place of the mechanical clutch and transfers power from the servo-motor to the knot-tying member. The coupling, known as a Schmidt Offset Coupling, is capable of maintaining the drive connection between the servo-motor and the knot-tying member, notwithstanding the variable misalignment of shafts due to the engaging and retracting of the knot-tying member. The Schmidt coupling therefore eliminates the excessive noise and wear commonly associated with the mechanical clutch and enables the independent drive of the knot-tying member.

SUMMARY OF THE INVENTION

The present invention provides a knot-tying mechanism having an alternative to the Schmidt coupling, which also permits the independent drive of the knot-tying member and eliminates the excessive noise and wear associated with the prior art mechanical clutch. Generally, the invention provides substantially all of the features of the knot-tying mechanism disclosed in U.S. Pat. No. 5,477,893, which is hereby incorporated by reference, but it incorporates a robust linkage in place of the prior art Schmidt coupling.

More specifically, the present invention provides a coil spring knotting machine including a frame and a camshaft mounted on the frame about an axis fixed relative to the frame. The camshaft supports a support member having thereon a knot-tying member mounted for rotation about an axis movable with respect to the frame. The camshaft also supports a free-wheeling rotating member. The machine further includes a first drive member rotatably driving the camshaft without causing rotation of the rotating member, and a second drive member rotatably driving the rotating member without causing rotation of the camshaft. A linkage connects the rotating member to the knot-tying member to rotate the knot-tying member. Preferably, the linkage includes a flexible member and a movable tensioning member for adjusting the tension in the flexible member.

Other features and advantages of the invention will become apparent to those skilled in the art upon review of the following detailed description, claims, and drawings.

Figure 2:
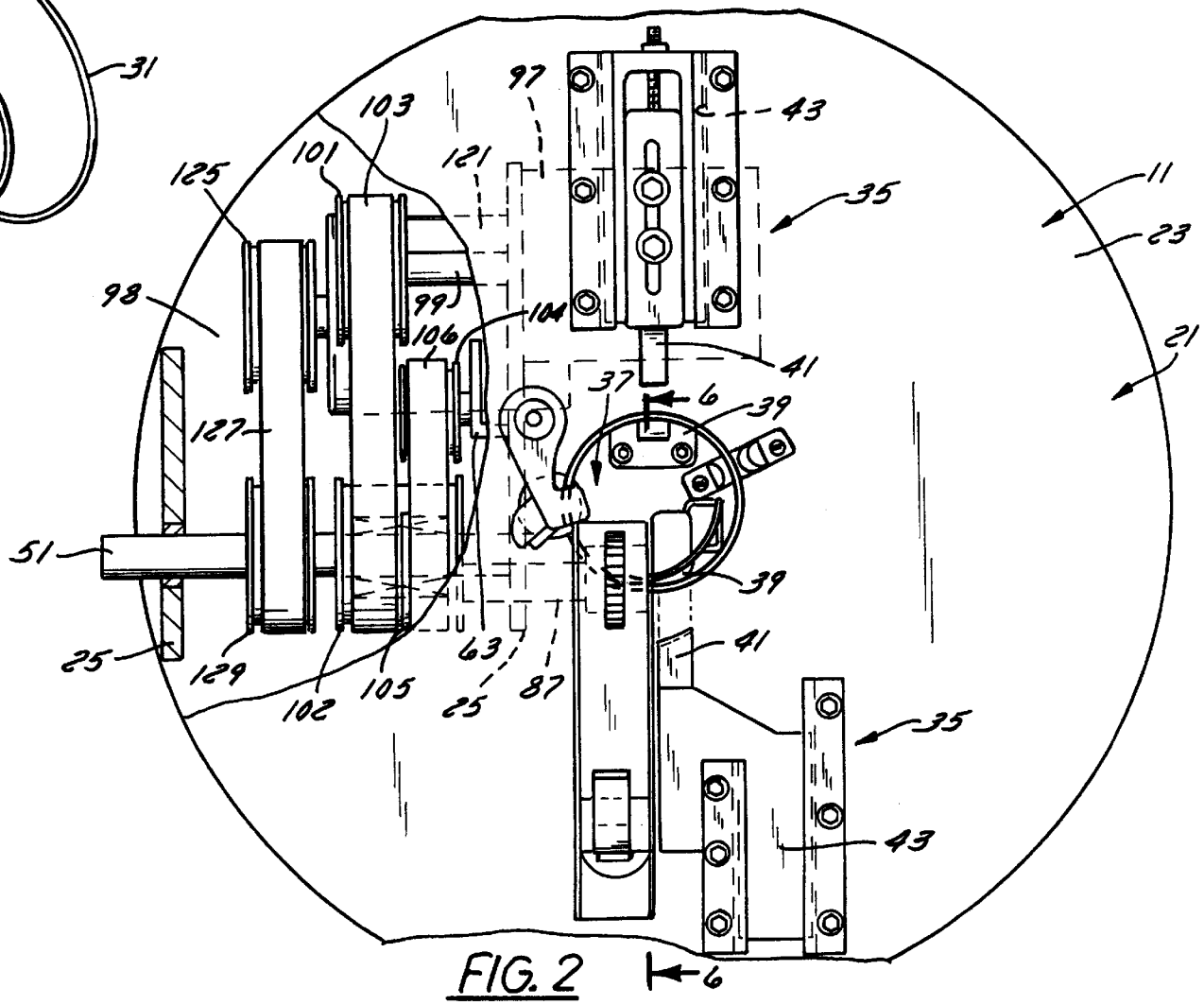
FIG. 2 is an elevational view, with certain parts omitted, of a machine for manufacturing the knots of the helical coil spring shown in FIG. 1, the machine incorporating various features of the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

Figure 1:
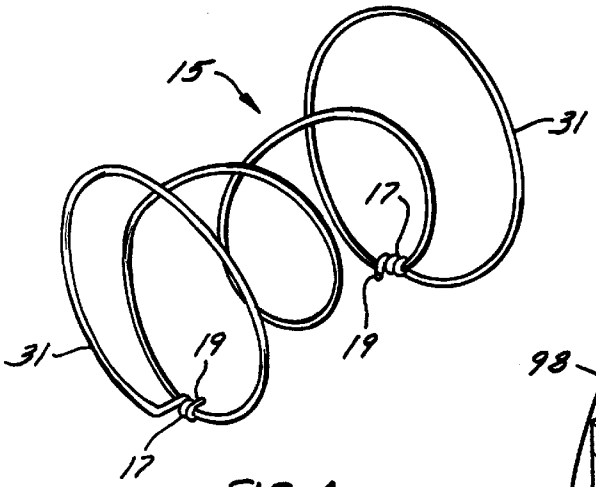
FIG. 1 is a perspective view of a knotted helical coil spring.

The drawings are illustrative of a machine 11 which is operative to twist the free ends of (see FIG. 1) a helical coil spring 15 to obtain, at each end, a knot 17. In practice, both free ends 19 are simultaneously twisted to obtain the end knots 17 by generally identical mechanisms which are included in the machine 11. Accordingly, only one of such mechanisms will be described.

Figure 3:
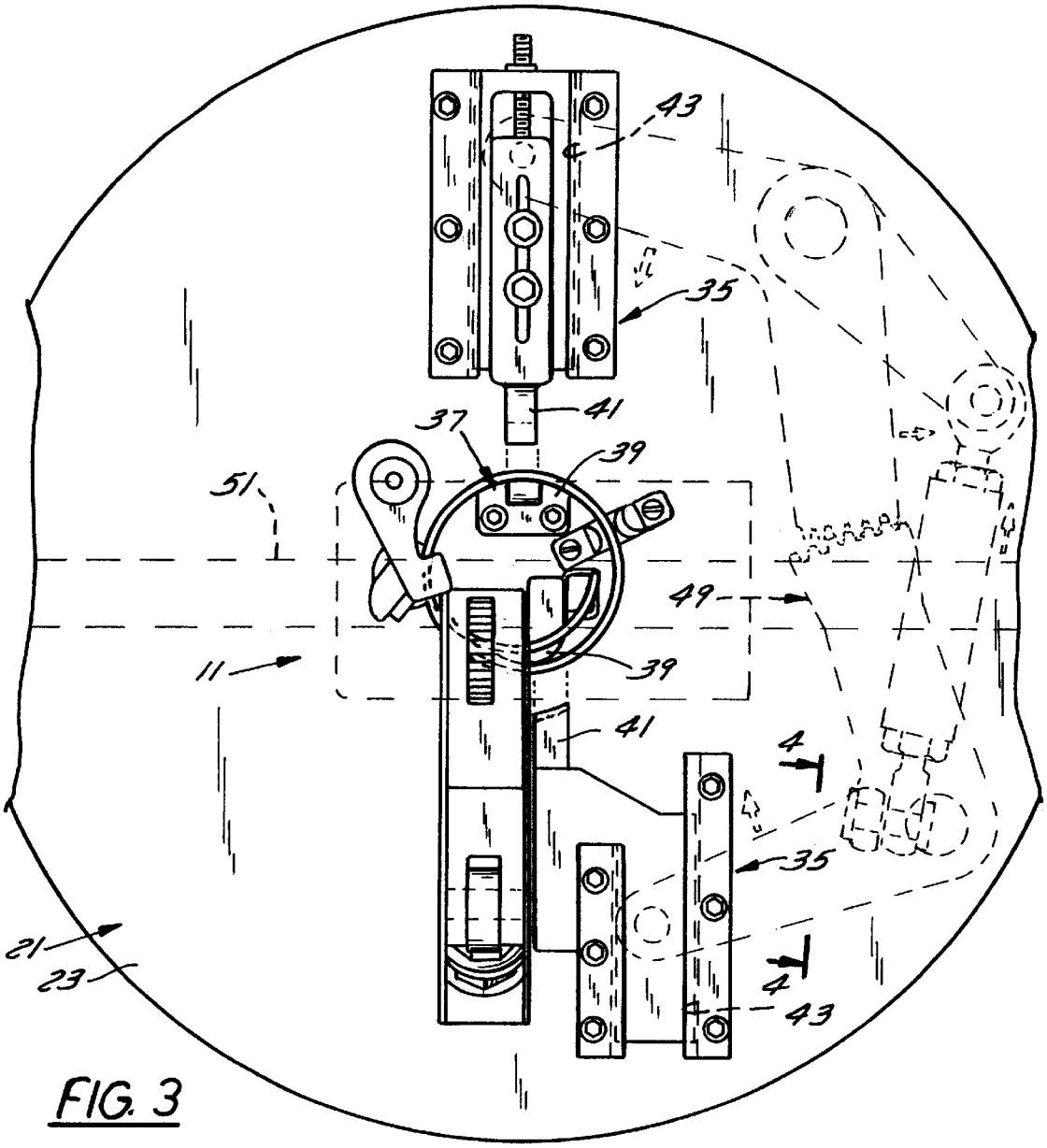
FIG. 3 is an elevational view similar to FIG. 2 with certain parts omitted and with other additional parts shown.
Figure 5:
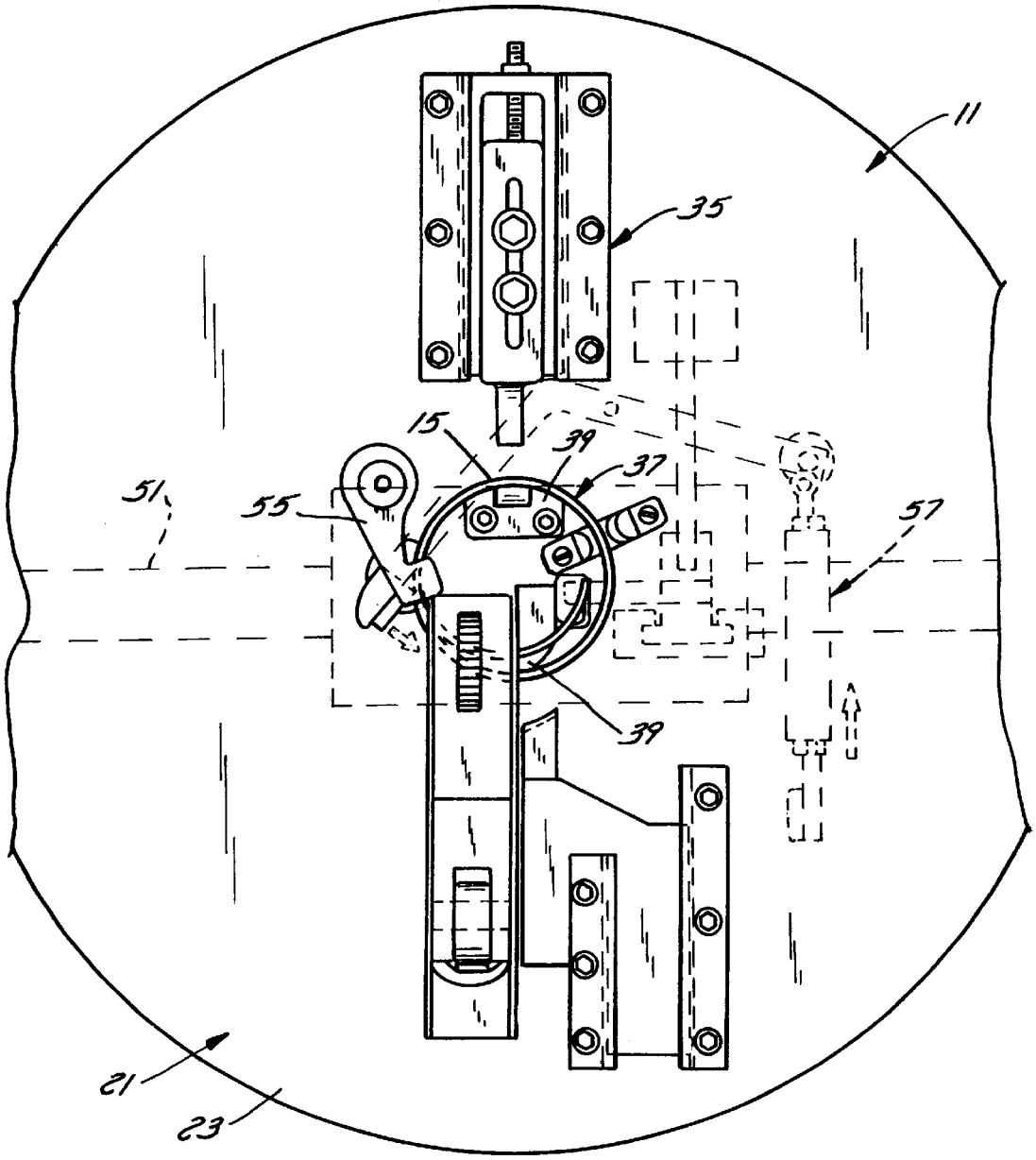
FIG. 5 is an elevational view similar to FIG. 3 with certain parts omitted and with other additional parts shown.

Referring to FIGS. 2, 3 and 5, the machine 11 comprises a frame 21 which includes spaced and parallel end members 23 and 24. The end members 23 and 24 can be of any shape, and in the disclosed construction, are generally circular in shape. The end members 23 and 24 are rigidified by a plurality of cross members 25 fixedly connected thereto.

Figure 4:
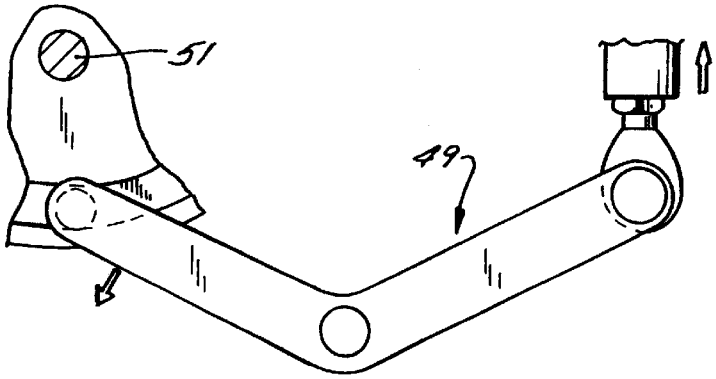
FIG. 4 is a fragmentary sectional view taken along line 4—4 of FIG. 3.

Prior to twisting of a free end 19 to produce an end knot 17, an end coil spring convolusion 31, adjacent the free end 19, is grasped and clamped by the machine 11 to hold the end convolusion 31 of the coil spring 15 securely in place. Thus, the machine 11 includes (see FIGS. 2 and 3) gripping or clamping means 35 comprising a segmented support 37 which is fixed on the end member 23. The segmented support 37 includes a pair of fixed anvil or clamping block portions 39, and a pair of movable clamps or jaws 41 which are respectively linearly reciprocal along suitable guides 43 fixed on the end member 23. The clamps or jaws 41 are linearly reciprocal relative to the anvil portions 39 so as to clamp generally oppositely disposed portions of the end convolution 31 of the coil spring 15 in fixed position about the support 37 and on the end member 23 of the frame 21. The clamps or jaws 41 are displaced between clamping and retracted positions by (see FIG. 3) a cam driven mechanism 49 which includes (see FIG. 4) a camshaft 51 supported for rotation on the frame 21.

The machine 11 also includes (see FIG. 5) a stop member 55 which is movable into the path of the adjacent free end 19 of the coil spring 15 to properly locate the free end 19 of the coil spring 15. By properly locating the free end 19, the stop member 55 enables the twisting of the free end 19 about the adjacent portion of the end convolution 31 to produce the knot 17 having the desired number of turns, and therefore to adjustably controls the length of the extending free end 19 of the coil spring 15. The stop member 55 is displaceable between a stop position and a retracted position by a cam driven mechanism 57 which includes the above-mentioned camshaft 51.

Figure 6:
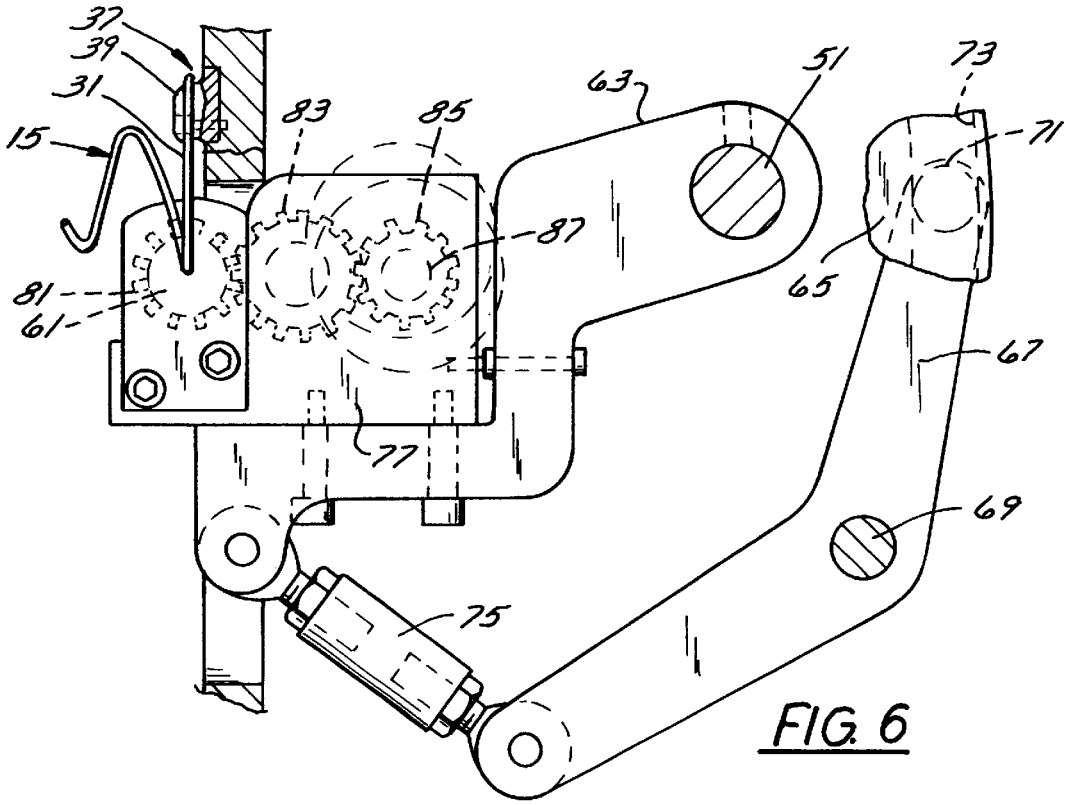
FIG. 6 is a fragmentary sectional view taken along line 6—6 of FIG. 2, and illustrating a knot twisting mechanism in a knot-tying or twisting position.
Figure 7:
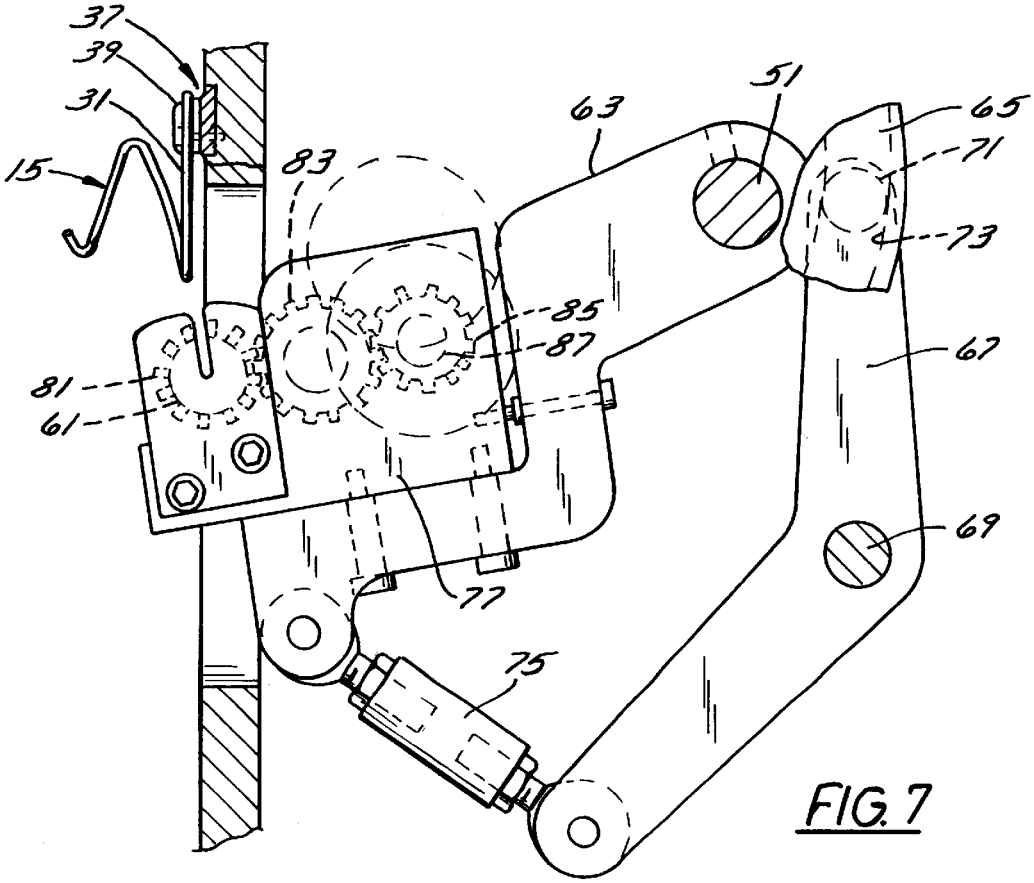
FIG. 7 is a fragmentary sectional view similar to FIG. 6 and illustrating certain other components of the knot twisting mechanism in a retracted position.
Figure 10:
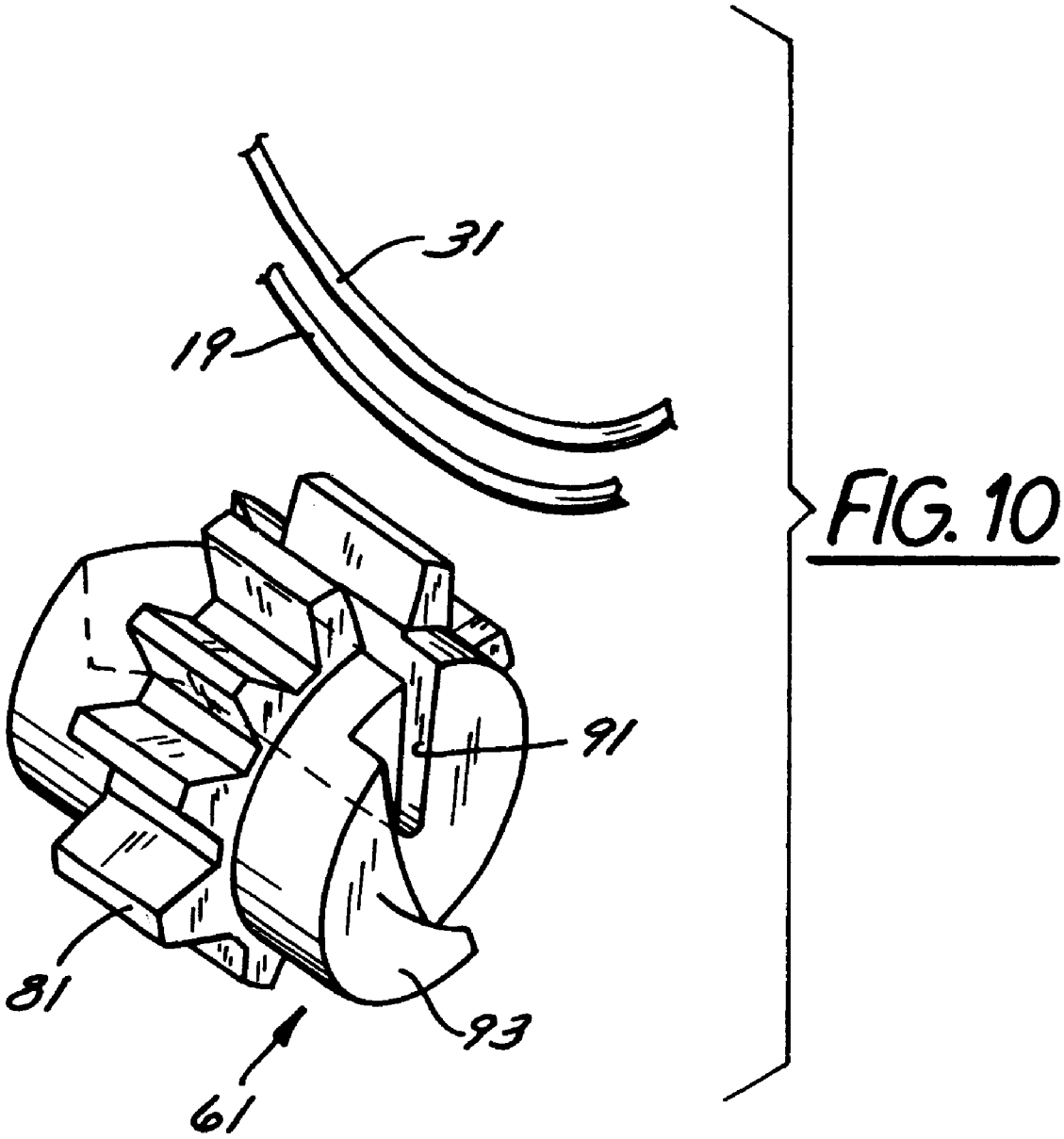
FIG. 10 is a perspective view of the knot-tying or twisting member employed in the machine shown in FIG. 2.

When the coil spring 15 is clamped in proper position for the knot-tying operation, a knot-tying or twisting member or knotting gear 61 (shown in FIG. 10) is moved from a retracted position (shown in FIG. 7) into an operative knot-tying or twisting position (shown in FIG. 6) and is rotated to produce the knot 17. More particularly, the knot-tying or twisting member 61 is rotatably supported on a support arm 63 which is rotatably mounted on the above-mentioned camshaft 51. The camshaft 51 also carries a support arm driving cam 65.

The support arm 63 is displaceable between a knot-tying or twisting position and a retracted position by any suitable mechanism which, in the disclosed construction, takes the form of a rocker-arm linkage including a rocker arm 67 which is pivotally mounted on the frame 21 about a stud 69. Fixed to one end of the rocker arm 67 is a cam roller 71 operable in a cam slot 73 in the support arm driving cam 65 on the camshaft 51. Pivotally connected to the other end of the rocker arm 67 is a connecting link 75. The connecting link 75 is also pivotally connected to the support arm 63, and therefore links the rocker arm 67 and the support arm 63. Rotation of the camshaft 51 thus moves the support arm 63 between the knot-tying or twisting position and the retracted position.

Fixedly mounted on the support arm 63 is a subframe 77 which supports the knot-tying or twisting member 61 for rotation about an axis fixed relative to the support arm 63. The knot-tying or twisting member 61 includes (see FIG. 11) a gear portion 81 that meshes with an idle gear 83 which is supported on the subframe 77 for rotation about an axis fixed relative to the subframe 77 (and relative to the support arm 63). In turn, the idle gear 83 meshes with a drive gear 85 which is fixedly mounted on a driven shaft 87. The driven shaft 87 is journaled by the subframe 77 for rotation about an axis that is fixed relative to the subframe 77 (and relative to the support arm 63), but that is movable relative to the frame 21.

As shown in FIG. 11, the knot-tying or twisting member 61 also includes an axial slot 91 which extends from the rotational axis thereof The axial slot 91 is adapted to receive the adjacent portion of the adjacent end convolution 31 of the coil spring 15 when the knot-tying or twisting member 61 is moved into the knot-tying position, thereby permitting rotation of the knot-tying or twisting member 61 about the adjacent portion of the adjacent end convolution 31.

The knot-tying or twisting member 61 further includes a raised portion 93 which engages the adjacent free end 19 of the adjacent end convolution 31 and which, in response to rotation of the knot-tying or twisting member 61 about the adjacent portion of the end convolution 31, bends the free end 19 around the end convolution 31 to a variably adjustable predetermined number of degrees, i.e., from one turn, to two and a half or more turns.

When the knot-tying operation is complete, the knot-tying or twisting member 61 is withdrawn from the end convolution 31. It is, of course, apparent that during movement of the knot-tying or twisting member 61 to and from the knot-tying position, the slot 91 must be aligned with the wire of the end convolution 31 to respectively receive the adjacent portion of the end convolution 31 and permit withdrawal of the end convolution 31.

Figure 8:
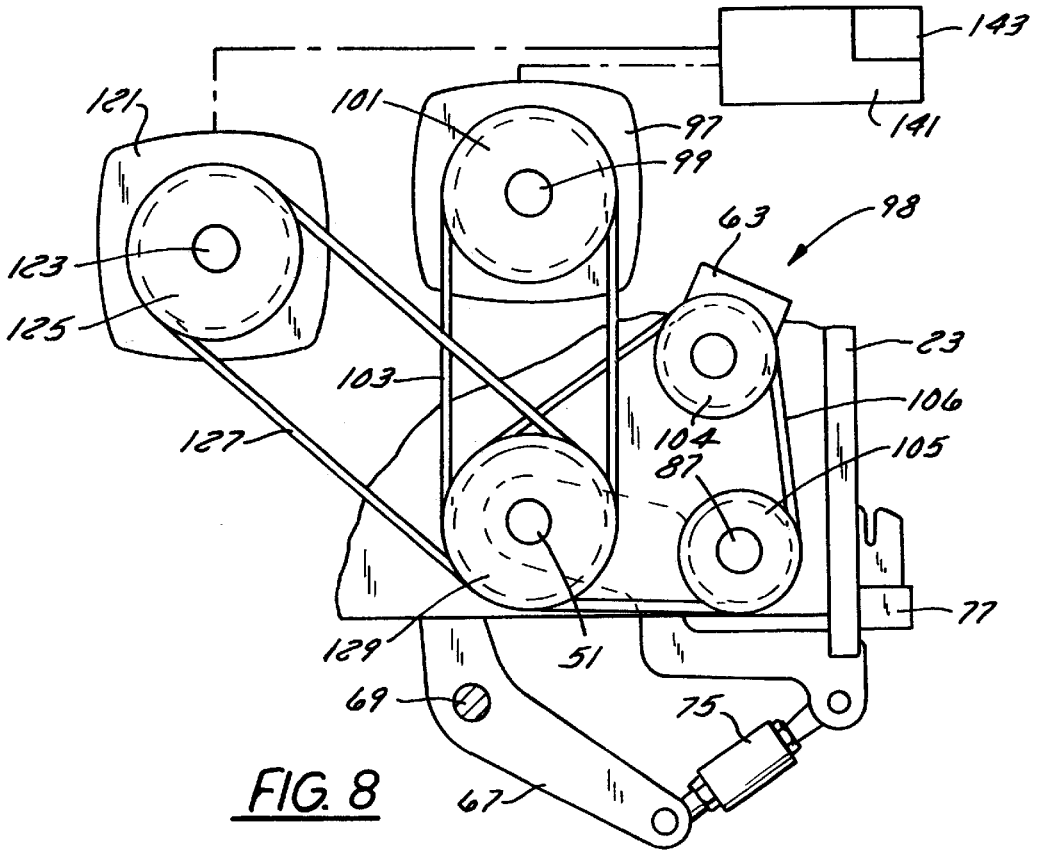
FIG. 8 is an enlarged partial elevational view (taken at a right angle to the views of FIGS. 2, 4, and 5) illustrating the drive arrangement of the machine shown in FIG. 2.
Figure 9:
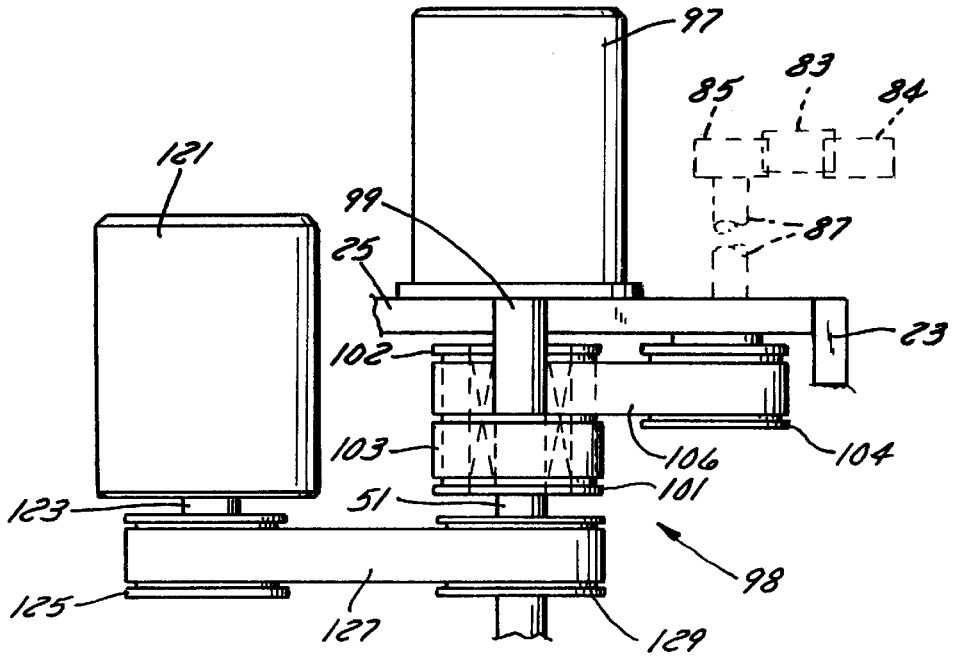
FIG. 9 is a top view of the components shown in FIG. 8.

In order to obtain the advantages of the invention, the driven shaft 87 is rotatably driven by (see FIGS. 2, 8, and 9) a suitable first drive member 97. A linkage generally designated as 98 transfers power from the first drive member 97 to the driven shaft 87. The first drive member 97 can be any suitable driving device (such as a servo-motor, an electric motor, etc.) and is fixed on the frame 21, preferably at one of the cross members 25. The first drive member 97 includes an output shaft 99 having thereon a drive pulley 101. An intermediate pulley 102 is rotatably mounted on the camshaft 51 and is free-wheeling with respect to the camshaft 51. In other words, rotation of the camshaft 51 does not cause rotation of the intermediate pulley 102, and vice versa. A suitable timing belt 103 connects the drive pulley 101 and the intermediate pulley 102.

The linkage 98 also includes an idler or tensioner pulley 104 and a driven pulley 105. The idler pulley 104 is rotatably mounted to the support arm 63 and the driven pulley 105 is connected to the driven shaft 87. A suitable timing belt 106 connects the intermediate pulley 102, the idler pulley 104, and the driven pulley 105 to transfer power from the intermediate pulley 102 to the driven shaft 87. As described above, the driven shaft 87 then drives the knot-tying member 61.

In the illustrated embodiment, the intermediate pulley 102 has a longitudinal length suitable to accommodate both timing belts 103 and 106. The timing belt 103 drives rotation of the intermediate pulley 102, which in turn, drives the timing belt 106. To ensure that the tension on the timing belt 106 is suitable for the specific application, the idler pulley 104 is movably mounted on the support arm 63 for periodic adjustment.

It is important to note, that the linkage 98 is not limited specifically to the illustrated embodiment, but could include various other types of linkages that would accomplish the same power transfer. For example, the pulleys and timing belts could be replaced with suitable gear arrangements, cam and follower arrangements, or chain and sprocket arrangements.

The above-mentioned camshaft 51 is driven independently of the knot-tying or twisting member 61 through a one revolution cycle by (see FIGS. 2, 8, and 9) a suitable second drive member 121. Like the first drive member 97, the second drive member 121 can be any suitable driving device (such as a servo-motor, an electric motor, etc.) and is also suitably fixed to the frame 21, preferably by connection to one of the cross members 25. The second drive member 121 includes an output shaft 123 having fixed thereon a drive pulley 125 which, through a suitable timing belt 127, drives a driven pulley 129 mounted on the camshaft 51. Accordingly, the camshaft 51 is repetitiously driven through one revolution cycles by the second drive member 121.

The first and second drive members 97 and 121 are electrically connected to and controlled by an electronic control circuit which includes an electronic control unit 141. The electronic control unit is shown diagrammatically in FIG. 8 and is arranged to actuate the first drive member 97 in proper timed relation to the one revolution cycle of the second drive member 121. The construction of the electronic control unit 141 is believed to be well within ordinary skill in the art and, thus, a detailed description of the physical arrangement thereof is believed to be unnecessary.

The electronic control unit 141 includes a schematically-illustrated adjustment means 143 for varying the number of revolutions of the knot-tying or twisting member 61. The number of revolutions used (i.e., one, two, or three) determines, at least in part, the size of the resulting knot 17. Any suitable means known in the art can be employed to affect such adjustment in the electronic control unit 141. Use of the disclosed construction, including the first and second drive members 97 and 121, and the electronic control unit 141, greatly facilitates and simplifies variable-turn knot manufacture.

The disclosed construction provides control of the rotary operation of the knot-tying or twisting member 61 independently of the control of the rotary operation of the camshaft 51 by employment of the first and second drive members 97 and 121 and serves to eliminate the excessive noise created by the prior art machines due to prior noisy operation of the before mentioned prior art one revolution mechanical clutch. In addition, the disclosed construction serves to permit variation in construction of the knots 17 by varying the input to the adjustment means 143 of the control unit 141 and without requiring replacement of the before-mentioned partial gear in the machine. Still further, the disclosed construction is less expensive then prior arrangements.

Various features of the invention are set forth in the following claims.

What is claimed is:

1. A coil spring knotting machine comprising:

a frame;

a support arm mounted on said frame for movement between a knot-tying position and a retracted position;

a first shaft rotatably mounted on said frame about an axis fixed relative to said frame;

a mechanism movably mounted on said frame and operably connected to said first shaft and to said support arm for displacing said support arm between said knot-tying and retracted positions in response to rotation of said first shaft;

a first drive member rotatably drivingly connected to said first shaft to selectively effect rotation thereof;

a knot-tying member rotatably mounted on said support arm;

a second shaft supported by said support arm for rotation about an axis fixed relative to said support arm and movable relative to said frame, said second shaft being drivingly connected to said knot-tying member to effect rotation thereof in response to rotation of said second shaft;

a rotating member coupled to said first shaft;

a second drive member drivingly connected to said rotating member to effect rotation thereof;

a linkage drivingly connected between said rotating member and said second shaft for rotating said knot-tying member in response to rotation of said rotating member, notwithstanding movement of said support arm between said knot-tying and retracted positions; and an electronic control unit connected to said first and second drive members to cyclically rotate said first shaft so as to displace said support arm between said knot-tying and retracted positions and to cyclically rotate said second shaft so as to rotate said knot-tying member when said support arm is in said knot-tying position.

2. A coil spring knotting machine in accordance with claim 1 wherein said support arm is pivotally mounted on said first shaft.

3. A coil spring knotting machine in accordance with claim 1 and further including a hydraulic motor intermediate one of said connected first drive member and said first shaft and said connected second drive member and said rotating member.

4. A coil spring knotting machine in accordance with claim 1 wherein said rotating member is free-wheeling with respect to said first shaft.

5. A coil spring knotting machine in accordance with claim 1 wherein said second drive member is connected to said rotating member via a flexible member.

6. A coil spring knotting machine in accordance with claim 1 wherein said linkage includes a flexible member connecting said rotating member to said second shaft.

7. A coil spring knotting machine in accordance with claim 6 wherein said linkage further includes a movable tensioning member for adjusting the tension in said flexible member.

8. A coil spring knotting machine in accordance with claim 1 wherein said rotating member is a pulley having a longitudinal length capable of accommodating a first flexible member that connects said second drive member to said rotating member, and a second flexible member that connects said rotating member to said second shaft.

9. A coil spring knotting machine in accordance with claim 1 wherein said electronic control unit includes an adjustment means for varying the amount of rotation of said knot-tying member.

10. A coil spring knotting machine comprising:

a frame;

a camshaft mounted on said frame about an axis fixed relative to said frame;

a support arm mounted on said camshaft for movement between a knot-tying position and a retracted position;

a rocker arm movably mounted on said frame and operably connected to said camshaft and to said support arm for displacing said support arm between said knot-tying and retracted positions in response to rotation of said camshaft;

a first drive member rotatably drivingly connected to said camshaft to selectively effect rotation thereof;

a knot-tying member rotatably mounted on said support arm about an axis fixed relative to said support arm;

a driven shaft supported by said support arm for rotation about an axis fixed relative to said support arm and movable relative to said frame, said driven shaft being drivingly connected to said knot-tying member to effect rotation thereof in response to rotation of said driven shaft;

a rotating member coupled to said camshaft;

a second drive member drivingly connected to said rotating member to effect rotation thereof;

a linkage drivingly connected between said rotating member and said driven shaft for rotating said knot-tying member in response to rotation of said rotating member, notwithstanding movement of said support arm between said knot-tying and retracted positions; and an electronic control unit connected to said first and second drive members to cyclically rotate said camshaft so as to displace said support arm between said knot-tying and retracted positions and to cyclically rotate said driven shaft so as to rotate said knot-tying member when said support arm is in said knot-tying position, said electronic control unit including adjustment means for varying the amount of knot-tying rotation of said knot-tying member.

11. A coil spring knotting machine in accordance with claim 10 wherein said support arm is pivotally mounted on said camshaft.

12. A coil spring knotting machine in accordance with claim 10 and further including a hydraulic motor intermediate one of said connected first drive member and said camshaft and said connected second drive member and said rotating member.

13. A coil spring knotting machine in accordance with claim 10 wherein said rotating member is free-wheeling with respect to said camshaft.

14. A coil spring knotting machine in accordance with claim 10 wherein said second drive member is connected to said rotating member via a flexible member.

15. A coil spring knotting machine in accordance with claim 10 wherein said linkage includes a flexible member connecting said rotating member to said driven shaft.

16. A coil spring knotting machine in accordance with claim 15 wherein said linkage further includes a movable tensioning member for adjusting the tension in said flexible member.

17. A coil spring knotting machine in accordance with claim 10 wherein said rotating member is a pulley having a longitudinal length capable of accommodating a first flexible member that connects said second drive member to said rotating member, and a second flexible member that connects said rotating member to said driven shaft.

18. A coil spring knotting machine comprising:

a frame;

a camshaft mounted on said frame about an axis fixed relative to said frame, said camshaft supporting a support member having thereon a knot-tying member mounted for rotation about an axis movable with respect to said frame, and a free-wheeling rotating member;

a first drive member rotatably driving said camshaft without causing rotation of said rotating member;

a second drive member rotatably driving said rotating member without causing rotation of said camshaft; and a linkage connecting said rotating member to said knot-tying member to rotate said knot-tying member.

19. A coil spring knotting machine in accordance with claim 18 wherein said linkage includes a flexible member.

20. A coil spring knotting machine in accordance with claim 19 wherein said linkage further includes a movable tensioning member for adjusting the tension in said flexible member.

* * * * *